US008771106B1

(12) United States Patent
Boulanger et al.

(10) Patent No.: US 8,771,106 B1
(45) Date of Patent: Jul. 8, 2014

(54) TRAINING AND REHABILITATION DEVICE FOR BALL THROWING

(71) Applicants: Todd M. Boulanger, St. Petersburg, FL (US); John Bordelon, St. Petersburg, FL (US); Earl Perrin, St. Petersburg, FL (US)

(72) Inventors: Todd M. Boulanger, St. Petersburg, FL (US); John Bordelon, St. Petersburg, FL (US); Earl Perrin, St. Petersburg, FL (US)

( * ) Notice: Subject to any disclaimer, the term of this patent is extended or adjusted under 35 U.S.C. 154(b) by 0 days.

(21) Appl. No.: 14/048,195

(22) Filed: Oct. 8, 2013

Related U.S. Application Data

(60) Provisional application No. 61/819,208, filed on May 3, 2013.

(51) Int. Cl.
*A63B 69/00* (2006.01)
*A63B 37/00* (2006.01)

(52) U.S. Cl.
CPC ..... *A63B 37/00* (2013.01)
USPC ..... 473/423; 473/422; 473/506

(58) Field of Classification Search
CPC ..... A63B 37/00; A63B 37/02; A63B 43/007; A63B 43/00
USPC ..... 473/422, 423–430, 506, 575, 576, 600
See application file for complete search history.

(56) References Cited

U.S. PATENT DOCUMENTS

| | | | | | |
|---|---|---|---|---|---|
| 2,484,475 | A | * | 10/1949 | Studer | 473/575 |
| 4,088,319 | A | * | 5/1978 | Clarke | 473/575 |
| 4,266,781 | A | * | 5/1981 | Blue | 473/585 |
| 4,267,685 | A | * | 5/1981 | Cragin | 54/1 |
| 4,294,447 | A | * | 10/1981 | Clark | 473/575 |
| 5,398,928 | A | * | 3/1995 | Rudell et al. | 473/575 |
| 5,560,320 | A | * | 10/1996 | Plunk | 119/709 |
| 5,660,576 | A | * | 8/1997 | Winga | 446/490 |
| 5,813,931 | A | * | 9/1998 | Gormley | 473/575 |
| 5,961,406 | A | * | 10/1999 | Hass | 473/576 |
| 6,705,960 | B2 | * | 3/2004 | Gormley | 473/417 |
| 6,733,405 | B2 | * | 5/2004 | Gormley | 473/575 |
| 2003/0224879 | A1 | * | 12/2003 | Hansberry | 473/423 |

* cited by examiner

*Primary Examiner* — Mitra Aryanpour
(74) *Attorney, Agent, or Firm* — Andriy Lytvyn; David Jacobs; Smith & Hopen, P.A.

(57) ABSTRACT

A device for training and rehabilitation includes a ball with a plurality of holes placed at predetermined locations. Each hole is adapted to receive and retain a receptor apparatus. The receptor apparatus contains a key receptor. A tether apparatus has a key fitting piece adapted for insertion into the key receptor. The key fitting piece is used to selectively lock the tether apparatus within the receptor apparatus. The tether apparatus includes a loop. A rope attaches to the loop, and the free end of the rope is frayed.

15 Claims, 3 Drawing Sheets

TRAINING AND REHABILITATION DEVICE FOR BALL THROWING

CROSS REFERENCE TO RELATED APPLICATIONS

This application claims priority to currently U.S. Provisional Patent Application No. 61/819,208, filed on May 3, 2013, entitled "Training and Rehabilitation Device for Throwing," the contents of which are hereby incorporated by reference.

BACKGROUND OF THE INVENTION

1. Field of the Invention

This invention relates to a training and rehabilitation device. More specifically, it relates to a simulation throwing device designed to rehabilitate and train throwing arms of individuals.

2. Brief Description of the Related Art

There are several important variables that contribute to developing a proper ball-throwing technique. Among the most important factors for developing a proper throw are proper body mechanics and learned muscle routines. In order to develop proper body mechanics and muscle routines, players and coaches often develop drills designed to mimic—and sometimes exaggerate—specific aspects of a throw. Various training aids are often employed to assist players in performing the ball-throwing drills.

One particular drill that has become very popular in baseball is known as the "towel drill."While several variations of the "towel drill" exist, the most common version involves a player performing a throwing motion while gripping a towel in the throwing hand. A target is orientated a specific distance away from the player. The player performs the throwing motion with the intention of striking the target with the towel. This drill is said to generally achieve two purposes: developing and improving proper throwing extension and helping with overall control through head-body-arm alignment.

However, using a towel to simulate a throwing motion has several major drawbacks. First, using a towel fails to provide realistic throwing mechanics. Developing proper muscle memory requires consistency and adherence to the proper form. Practicing ball-throwing technique while gripping a towel does not allow a player to maintain proper ball throwing grip throughout the motion. This is particularly important for baseball pitches, where slight changes in a grip can lead to large variations in how the ball leaves the pitcher's hand. Moreover, a towel does not have the weighted feel of a baseball, which may result to undesirable outcome because using incorrect weight when developing muscle memory may lead to incorrect throwing speed and off-timed throws. Using a towel may prevent the player from achieving proper velocity and acceleration through an entire throw—and instead of improving the throwing technique, may deteriorate the skill of the player. Finally, the towel drill does not allow the player to simultaneously practice the full motion of a throw and gripping techniques, both of which are essential.

Several training devices aimed at improving pitching and throwing technique are known in the art. For example, U.S. Pat. No. 7,955,197, issued Jun. 7, 2011 to Kenneth A. Roudybush discloses a device that provides the user with an audible feedback in response to the user's throwing motion, where the feedback varies based on the amount of centripetal acceleration exerted by the circular rotation of the user's arm. This device has several fundamental flaws. First, the feedback mechanism is housed within a rigid housing suspended from the ball by a flexible rope allowing the housing to swing around as the user moves his arm in circular motion. This makes the device unfit for replicating a towel drill because the solid housing would strike the target, which may send a shock trough the rope causing an injury to the user's arm. Moreover, when the throw is performed incorrectly, the feedback mechanism may strike the user inflicting bodily injury. Also, when bystanders are present in a close vicinity to the user, they are also in a danger of being struck by the housing of the feedback mechanism and suffering an injury. Furthermore, the weight of the feedback mechanism alters the feel of a throw, therefore diminishing the simulations of a normal throwing technique.

Another example of a throwing training device is disclosed in U.S. Pub. App. No. 2007/0105663, published May 10, 2007 to Steven Lee Farnsworth and Kenneth A. Roudybush. This device suffers from similar flows as the '197 patent. While potentially effective in stretching out a thrower's arm, both devices fail to provide a complete training and rehabilitation device that mimics proper throwing techniques. Arm rotation of a throw is rarely limited solely to rotation in a large circular motion. Players, especially those in the sport of baseball, throw the ball using their entire body—a technique which the devices currently known in the art cannot properly simulate. Finally, the ball throwing training devices known in the art do not facilitate proper ball gripping techniques and do not allow the user to quickly transition the training device to adjust to different grips—in fact, they may actually impede proper gripping technique.

U.S. Pub. App. No. 2007/0155544, to Darryl B. Killion and U.S. Pat. No. 7,976,414 to David McKay describe a throwing device that includes a baseball attached to a band. The '968 device utilizes an elastic band and adjustable finger strap. The '414 device utilizes a substantially non-elastic band with an adjustable wrist strap. In either case, the goal of these devices is for a user to physically throw a ball, which then returns to the user upon release. The result is that a user may imitate a throwing form without having to retrieve the ball after every throw. These device, however, require a modified throwing form that can prove harmful to the thrower. For example, a player using such device must throw the ball around his body. This results in a motion that requires the arm to start perpendicular to the body and rotate across the body. The resulting motion allows the ball to circle around and return to the user, but forces the player to use a throw that is against proper throwing mechanics. This flaw is especially pertinent for baseball players because the proper throwing technique is essential in this sport. Additionally, these devices lack a feedback mechanism capable of indicating a proper throw has been achieved. Finally, none of the training devices currently known in the art are capable of provide an adjustable gripping position, such that the user may move the rope attachment location to allow access to different portions of the ball.

Accordingly, there exists a need for a device that can be utilized for both rehabilitation and training. Such a device must be able to accurately simulate the technique necessary for a proper throw. In addition, there exists a need for a device that is adaptable to quickly transitioning between different grips and styles of throwing. Finally, there exists a need for a device that provides feedback to encourage proper throwing technique. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

The longstanding but heretofore unfulfilled need for a training and rehabilitation device allowing the user practice a proper ball-throwing motion while using a variety of grips is now met by a novel and nonobvious invention.

A training device according to the present invention includes a ball having a core and a surface enclosing the core. At least one blind hole is pre-drilled into the ball. The hole opens to the surface of the ball. A receptor apparatus is inserted and retained within the hole. A tether apparatus is selectively securable within the receptor apparatus and may be readily removed from one receptor apparatus and placed within another receptor apparatus, allowing the user to quickly adapt the training device to a desired grip. A rope is attached to the tether apparatus, and the free end of the rope is frayed.

In an embodiment, the mechanism for securing the tether apparatus within receptor apparatus involves one end of the tether apparatus having a key fitting member. The receptor apparatus has a key receptor adapted to receive the key fitting member. The distal end of the receptor apparatus has a notch. To secure the tether apparatus within the receptor apparatus, the key fitting member is inserted into the key receptor and turned to a position where the key fitting member engages the notch of the receptor apparatus. A biasing member may be used to bias the key fitting member toward the notch, therefore, lodging the key fitting member into the notch securing the tether apparatus within the receptor apparatus.

The receptor apparatus may be retained within the hole in the ball by one or several ribs transversely disposed on a lateral surface of the receptor apparatus. The distal end of receptor apparatus may include a flange.

A conjuncture of the rope and the tether apparatus may be shrink-wrapped to increase the strength of connection between the rope and the tether apparatus. The rope may be between twenty to sixty inches long.

In an embodiment, the receptor apparatus and the tether apparatus may be made of a plastic material. The rope may be made of a material selected from the group consisting of hemp, cotton, linen, straw, sisal, polypropylene, polyester, nylon, and a combination thereof.

Each hole should be positioned on the ball in a location that allows a user to hold the ball using a pre-defined grip without interferences from the shaft of the tether apparatus. Preferably the shaft passes between the user's fingers without touching them.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

Figure 1:
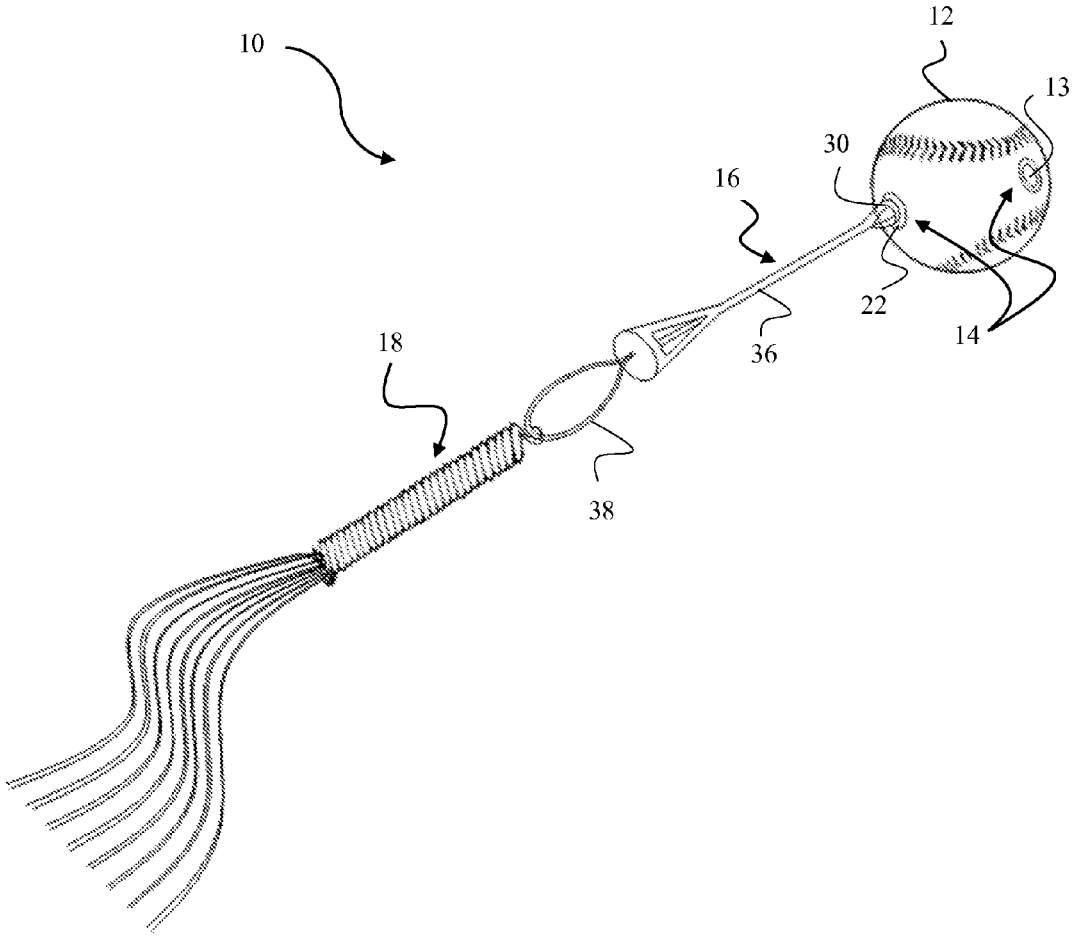
FIG. 1 is a schematic perspective view of the training device according to the present invention.

In general, a training device 10 in accordance with the present invention is depicted in FIG. 1. Training device 10 includes a ball 12 with at least one hole 13, a receptor apparatus 14, a tether apparatus 16, and a rope 18. Ball 12 may be any standardized sporting ball, which may include a baseball, a softball, a tennis ball, or any other ball used in sporting and recreation events. Rope 18 should be made of strong resilient material such as hemp, cotton, linen, straw, sisal, polypropylene, polyesters, nylon or any other material known in the art at the time of the invention to be used with rope. In a preferred embodiment, rope 18 is made of flexible, soft material. The length of rope 18 may vary depending on specific aspects of the intended application of training device 10, but should generally vary between twenty and sixty inches in length. The end of rope 18 is preferably frayed.

FIGS. 2A-D depict receptor apparatus 14 in accordance with a preferred embodiment of the present invention. Receptor apparatus 14 is adapted to be inserted and retained within hole 13 in ball 12. In a preferred embodiment, ball 12 contains a plurality of holes 13 allowing multiple receptor apparatuses 14 to be retained in different locations on ball 12. The multiple-receptor configuration allows the user to quickly and easily adapt training device 10 for different throwing grips. For example, when ball 12 is a baseball, it may be desirable for one receptor apparatus 14 to be located between the "narrow seams" facilitating a proper "two-seam" grip, and another receptor apparatus 14 to be positioned in proximity to the center of the "horseshoe seam" for a correct "four-seam" grip. Receptor apparatus 14 may further include a specific indicator to identify which grip should be used with that receptor apparatus 14.

Figure 2A:
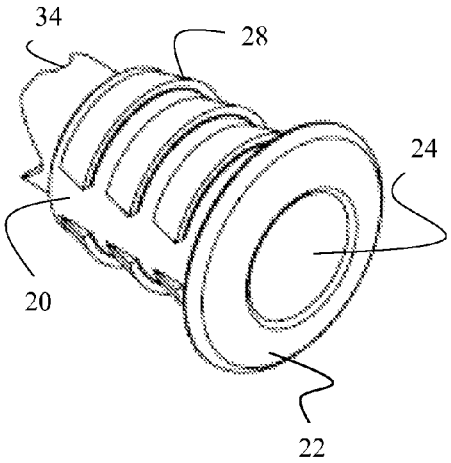
FIG. 2A is a perspective view of the receptor apparatus showing a proximal end thereof.
Figure 2B:
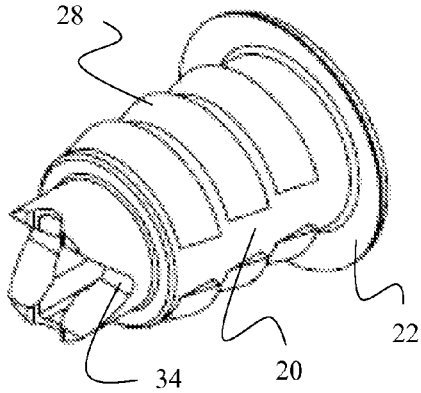
FIG. 2B is a perspective view of the receptor apparatus showing a distal end thereof.
Figure 2C:
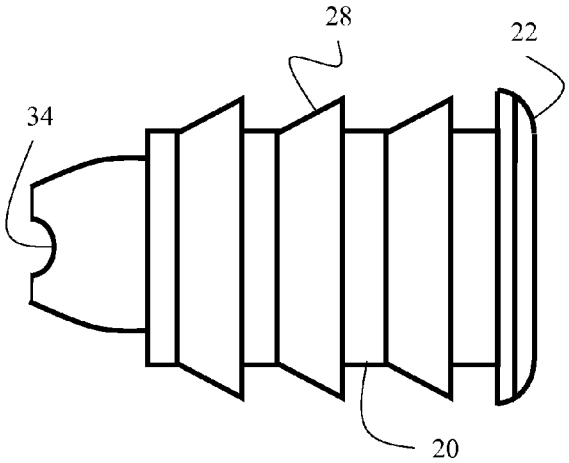
FIG. 2C is a side view of the receptor apparatus.

Receptor apparatus 14 has a substantially cylindrical body 20. As depicted in FIG. 2C, distal end of receptor apparatus 14 may be tapered to facilitate insertion into hole 13. Receptor apparatus 14 has a retention mechanism configured to secure receptor apparatus 14 within hole 13. Many retention mechanisms are known in the art and can be used with receptor apparatus 14. In the embodiment depicted in FIGS. 2A-D, a plurality of ribs 28 are transversely disposed on the lateral surface of cylindrical body 20. Ribs 28 protrude out of cylindrical body 20. Plurality of wing portions should be equidistantly spaced across cylindrical body and are angled toward the distal end of the receptor apparatus 14. This allows for easy insertion and difficult extraction due to the friction between ribs 28 and the interior packed yarn and exterior leather covering of ball 12. In the embodiment of FIGS. 2A-D, a plurality of ribs 28 are disposed in transversely spaced apart, parallel relation to one another as illustrated in FIG. 2C. Although a single flange may be sufficient for some types of hollow balls, such as a tennis balls, multiple ribs 28 are preferred for use with softballs and baseballs because each additional rib 28 results in greater friction force, therefore further securing receptor apparatus within ball 12.

Cylindrical body 20 has an inner cavity 24. The proximal end of cylindrical body 20 has an annular disk shape forming a flange 22 around exposed end of receptor apparatus 14. Flange 22 prevents receptor apparatus 14 from being inserted too far into hole 13. If ball 12 is hollow, the shell of ball 12 is secured between rib 28 and flange 22, thus retaining receptor apparatus 14 within ball 12. Preferably, flange 22 has the same curvature as ball 12 into which receptor apparatus 14 is inserted. This allows receptor apparatus 14 to conform to the surface of ball 12, therefore, minimizing alteration of ball's 12 surface and facilitating natural feel of ball 12 allowing the user to properly grip ball 12.

Figure 2D:
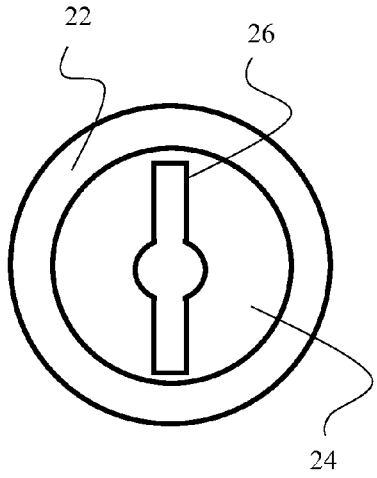
FIG. 2D is a front view of the receptor apparatus showing a key receptor.

Inner circumference of flange 22 defines an opening of inner cavity 24, which provides access to a key receptor 26. Key receptor 26 is positioned at the distal end of cylindrical body 20 and is accessible through inner cavity 24. Key receptor is illustrated in FIG. 2D.

Figure 3:
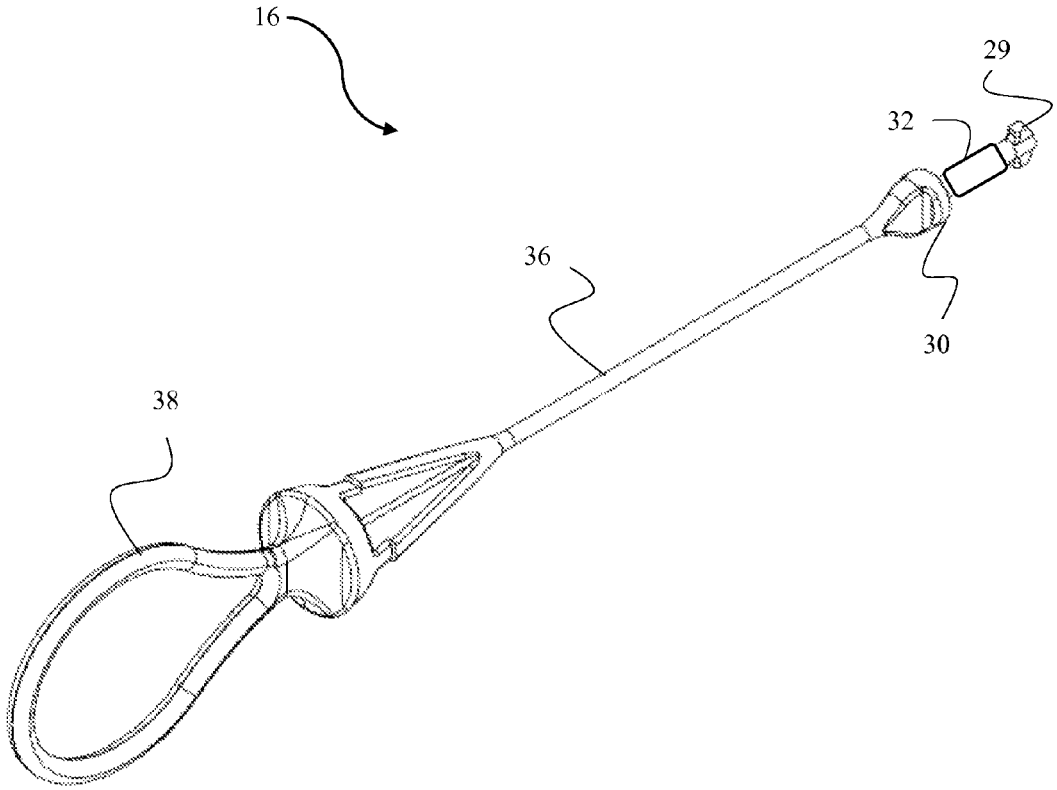
FIG. 3 is a perspective view of the tether apparatus.

FIG. 3 depicts tether apparatus 16. Tether apparatus 16 has a distal end and a proximal end. Distal end contains a key fitting piece 29 and a resting portion 30. Key fitting piece 29 is configured for insertion into key receptor 26. Tether apparatus 16 includes a biasing member 32 disposed between resting portion 30 and key fitting piece 29. To secure tether apparatus 16 within receptor apparatus 14, key fitting piece 29 is inserted into key receptor 26. Insertion of key fitting piece 29 results in compression of biasing member 32, which biases resting portion 30 away from receptor apparatus 14.

Once key fitting piece 29 is fully inserted into key receptor 26 against the biasing force, key fitting piece 29 is rotated by about 90°. The biasing force produced by compressed biasing member 32 lodges key fitting piece 29 into notches 34 of receptor apparatus 14, securing tether apparatus 16 within receptor apparatus 14. Biasing member 32 remains within inner cavity 24, and resting portion 30 is substantially flush with flange 22. This configuration minimizes alteration of ball's 12 surface allowing the user to properly grip ball 12. Preferably, biasing member 32 is hollow rubber tube. However, a helical compression spring or any other biasing member known in the art may be used. In a preferred embodiment, receptor apparatus 14 and tether apparatus 16 are made of a plastic material, preferably nylon.

To remove tether apparatus 16 from receptor apparatus 14, the user presses resting portion 30 into receptor apparatus 14 against the biasing force of biasing member 32 to dislodge key fitting piece 29 from notches 34. Key fitting piece 29 is then rotated by about 90° to align with key receptor 26, at which point key fitting piece 29 may be removed from receptor apparatus 14.

As shown in FIG. 3, an elongated shaft 36 radially extends from resting piece 30. A loop 38 is disposed on the proximate end of shaft 36. Loop 38 is connected to shaft 36 by a plurality of support members 40. Two loose ends of rope 18 are placed around loop 38 facing outward. In an alternative embodiment, a single rope 18 may be folded around loop 38 with ends facing outward. The place where loop 38 and rope 18 connect may be shrink wrapped in order to further secure rope 18 to loop 38. Ends of rope 18 are exposed and are preferably frayed. Fraying ends of rope 18 reduces the risk of injury or damage to the surrounding objects when the user performs throwing drills with training device 10.

Although training device 10 may be used in a variety of ways, one method of use resembles a popular "towel drill." The user inserts and locks tether apparatus 16 into receptor apparatus 14 corresponding to the grip the user wishes to practice. The user grips ball 12 in accordance with the user's grip preference. Shaft 36 of tether apparatus 16 passes between the user's fingers, thereby causing minimal interference with the natural grip. A target is placed out in front and a predefined distance away from the user. While gripping ball 12, the user performs an entire throwing motion with a proper head-body-arm alignment and correct full-body mechanics. The object of the training drill is to strike the target with frayed ends of rope 18. Ball 12 never leaves the user's hand during the drill allowing for continuous repetition of the throwing motion. This facilitates rapid development of muscle memory and improvement of the throwing technique.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

GLOSSARY OF THE CLAIM TERMS

Biasing member—a device that under compression exerts a constant force opposing the compression force Blind hole—a hole having a specific depth that is less than a diameter of the ball.

Key fitting member—a part at the distal end of the tether apparatus substantially perpendicular to the shaft. The key fitting member may be inserted into the opening of the key receptor when the key fitting member is aligned with the opening thereof. After the insertion, the key fitting member may be rotated into a misalignment with the key receptor, thus preventing removal of the key fitting member from the key receptor.

Key aperture—an opening in the receptor apparatus through which a key fitting member may pass when the key fitting member is in an alignment therewith.

Receptor—a female member configured to be retained within a hole in the ball and also configured to receive and selectively secure the distal end of the tether apparatus Tether apparatus—a member having an elongated shaft, a proximal end being adapted to be inserted and retained within receptor apparatus, and a distal adapted to couple to a rope.

What is claimed is:

1. A training device, comprising:

a ball having a solid core and a surface enclosing the core;

a seam disposed on the surface of the ball;

a first blind hole disposed within the core, opening to the surface of the ball, the first blind hole being positioned in a first predetermined location relative to the seam, wherein the first predetermined location corresponds to a first user grip;

a second blind hole disposed within the core opening to the surface of the ball, the second blind hole positioned in a second predetermined location relative to the seam, wherein the second predetermined location corresponds to a second user predefined grip;

a first receptor retained within the first blind hole;

a second receptor retained within the second blind hole;

a tether apparatus having a first end and a second end, the first end of the tether apparatus being selectively securable within the first or the second receptor; and a rope attached to the second end of the tether apparatus;

wherein the training device has a first configuration corresponding to the first user grip when the tether apparatus is secured within the first receptor and a second configuration corresponding to the second user grip when the tether apparatus is secured within the second receptor, the training device being transitionable between the first and the second configurations by releasing the tether apparatus from the first receptor and securing the tether apparatus within the second receptor.

2. The training device according to claim 1, further comprising:

a key fitting member disposed on the first end of the tether apparatus;

a first key aperture disposed within the first receptor;

a second key aperture disposed within the second receptor, wherein the first and the second key apertures are configured to receive the key fitting member of the tether apparatus;

a notch disposed on a distal end of each the first and the second receptors;

whereby the first end of the tether apparatus is selectively securable within the first or the second receptor by inserting the key fitting member into the first or the second key aperture and turning the key fitting member to a position where the key fitting member engages the notch.

3. The training device according to claim 2, further comprising a biasing member disposed around the first end of the tether apparatus, the biasing member configured to bias the key fitting member toward the notch thereby lodging the key fitting member into the notch.

4. The training device according to claim 1, further comprising at least one rib transversely disposed on a lateral surface of the first receptor, the rib configured to retain the first receptor within the hole in the ball.

5. The training device according to claim 1, further comprising a flange disposed on a distal end of each the first and the second receptors.

6. The training device according to claim 1, wherein a free end of the rope is frayed.

7. The training device according to claim 1, wherein a conjuncture of the rope and the tether apparatus is shrink-wrapped.

8. The training device according to claim 1, wherein a length of the rope is between twenty to sixty inches.

9. The training device according to claim 1, wherein the first receptor apparatus and the tether apparatus are plastic.

10. The training device according to claim 1, wherein the rope is made of a material selected from the group consisting of hemp, cotton, linen, straw, sisal, polypropylene, polyester, nylon, and a combination thereof.

11. The training device according to claim 1, wherein in the first configuration of the training device, the tether apparatus is configured to pass between the user's fingers thereby allowing the rope to swing when the user grips the ball using the first user grip.

12. The training device according to claim 1, wherein the ball is a baseball or a softball.

13. The training device according to claim 1, further comprising a target for placement at a predetermined distance away from the user, wherein the target is configured to be struck by the rope.

14. The training device according to claim 1, wherein the first user grip is a two-seam grip.

15. The training device according to claim 1, wherein the second user grip is a four-seam grip.

* * * * *